United States Patent [19]

Cherednichenko et al.

[11] 4,027,861

[45] June 7, 1977

[54] APPARATUS FOR CONTINUOUS VACUUM-REFINING OF METALS

[76] Inventors: Vladimir Semenovich Cherednichenko, ulitsa Zorge, 269, kv. 79; Gennady Ivanovich Orlov, ulitsa Vatutina, 27, kv. 20, both of Novosibirsk; Aron Semenovich Mikulinsky, ulitsa Bosova, 1, kv. 54, Istra Moskovskoi oblasti; Jury Semenovich Arzamastsev, ulitsa Zorge, 267, kv. 58, Novosibirsk; Vladimir Vasilievich Efremkin, ulitsa Gurzufskaya, 15a, kv. 23, Sverdlovsk, all of U.S.S.R.; Valentin Alexeevich Nikitin, deceased, late of Kishinev, U.S.S.R.; by Valentina Kuzminichna Nikitina, administrator; by Dmitry Valentinovich Nikitin, administrator, both of ulitsa Zelinskogo, 8, kv. 50,, Kishinev, both of U.S.S.R.

[22] Filed: Apr. 2, 1976

[21] Appl. No.: 673,106

[52] U.S. Cl. ..... 266/149; 13/8; 13/31

[51] Int. Cl.[2] ..... C22B 9/04

[58] Field of Search ..... 13/8, 31; 266/148, 149, 266/154, 208

[56] References Cited

UNITED STATES PATENTS 3,803,335 4/1974 Esjutin et al. ..... 13/31

*Primary Examiner*—Gerald A. Dost

[57] ABSTRACT

The present invention relates to apparatus for continuous refining of tin.

The apparatus comprises a vacuum chamber accommodating an evaporator which is a vessel with a granulated loose material filling the entire vessel volume to provide a maximum evaporating surface washed by molten metal being refined, with the vessel side walls being fitted with outlets for the effluence of impurity vapors, referred to hereinafter as volatilized impurities, liberated from said metal evaporating surface, and with the vessel bottom having drains for discharging refined metal from the vacuum chamber.

4 Claims, 3 Drawing Figures

APPARATUS FOR CONTINUOUS VACUUM-REFINING OF METALS

The present invention relates to metal processing equipment and more particularly to apparatus for continuous vacuum-refining of metals.

The invention may prove to be most advantageous in producing pure tin with a maximum impurity content of 2%.

A now-existing apparatus for continuous vacuum-refining of metals comprises a cylindrical vacuum chamber accommodating an evaporator shaped as a graphite tray column and adapted to receive preliminary melted impure metal; a central rod heater with a current lead adapted to feed electric energy thereto, or an inductor encompassing the graphite tray column to warm the evaporator with the metal and to evaporate low-boiling impurities therefrom. The apparatus is also furnished with a device for trapping and condensing impurity vapors, referred to hereinafter as volatilized impurities, liberated from the metal, and with a condensate header adapted to collect the liquefied impurities.

In the present-art apparatus the device for trapping and condensing the volatilized impurities, liberated from the metal being refined, is made in the form of either perforated shields, in an apparatus equipped with a central rod heater, or a vapor pipe, formed by outlets located in the centre of the trays, tapered branch pipes creating the ejection effect, and a condenser disposed under the graphite tray column, if the heater constitutes an inductor encompassing the graphite tray column.

For feeding the preliminary melted metal into the vacuum chamber and draining the distilled impurities and refined metal, use is made of pipelines made up of a metal casing and a graphite pipe enclosed therein.

A disadvantage of the now-existing apparatus resides in a small open metal surface in the tray, said surface determining the impurity evaporation rate. The main mass of the metal contained in the tray is buried at a depth with only a small layer being open to evaporate. The dipped impurities can travel to the open metal surface only due to diffusion which takes place at a very low speed. As a result, both an output provided by the apparatus and the degree of metal refining are too low.

The above disadvantage can be partly offset by increasing the number of trays and, hence, the total open metal surface, but it will lead to a considerable increase in overall dimensions of the apparatus and, if a central rod heater is employed, to serious difficulties to be met with in manufacturing such heaters of an increased length.

Another important disadvantage of the present-art apparatus lies in that they fail to provide an irregular distribution of produced energy along the height of the tray column.

A need for generating a larger amount of energy in the upper portion of the column is stipulated by the fact that the metal is heated to an impurity boiling point just in that part of the column. A maximum amount of impurities evaporate also in this portion of the tray column, this being substantiated by experience. As a result, the stability of the refining process diminishes.

A third disadvantage of the existing design consists in a small service life of the pipelines for feeding the preliminary melted metal to the vacuum chamber and for draining the impurities and refined metal therefrom. It is attributable to the fact that at high temperatures both the metal and impurities react actively with the pipeline material.

The main object of the invention is to provide an apparatus for continuous refining of metals with an evaporator so designed as to increase an apparatus output, reduce the specific consumption of electric energy and enhance the process stability and the quality of metal being refined.

Said object is achieved in an apparatus for continuous refining of metals, comprising a cylindrical vacuum chamber accommodating an evaporator for preliminary melted impure metal, a heater with a current lead for feeding electric energy thereto to warm the evaporator together with the metal to a volatilization temperature of low-boiling impurities, and a condensate header adapted to collect the impurities evaporating upon heating, wherein, according to the invention, the evaporator is a vessel with a granulated loose material filling its entire volume to provide a maximum evaporating surface washed by the metal being refined, with vessel side walls being fitted with outlets for the effluence of volatilized impurities liberated from said metal evaporating surface, and with its bottom having drains for discharging the refined metal from the vacuum chamber.

Since the metal being refined spreads in the evaporator in the form of a thin film, enveloping each granule of the loose material, the surface of evaporation of impurities is greatly increased. And as the metal contained in the evaporator assumes the shape of a thin film, actually the impurity volatilizing process takes place from the entire volume of the metal, a feature enchancing substantially both an apparatus output and the degree of metal refining.

In order to increase the rate of withdrawal of the volatilized impurities from the evaporator, use is made of the apparatus with the heater disposed externally of the evaporator, e.g., an induction heater. This affords the possibility of forming a vapor pipe along the evaporator axis.

To this end the vessel is produced by two cylinders arranged coaxially with respect to each other, aligned with the vacuum chamber and separated by a clearance filled with the granulated loose material, with said outlets for the effluence of the volatilized impurities being made in the walls of the internal cylinder which accommodates tapered branch pipes spaced at a certain distance, aligned axially therewith and forming, in conjunction with the cylinder space, a vapor pipe for the passage of impurities, communicating with the condensate header whose outlet is fitted with a pipeline enclosed in a water-cooled jacket and provided with an electric heater.

The tapered branch pipes disposed in the space of the said internal cylinder at a certain distance from one another create the impurity ejection effect increasing thereby the rate of withdrawal of the volatilized impurities, a feature contributing to a higher apparatus output.

To enable the redistribution of energy along the evaporator height, the metal being refined is employed as a heater. In order to increase the amount of energy released in the upper portion of the evaporator, the cylinder filled with the granulated loose material is shaped as a truncated cone turned with its enlarged portion downwards.

Thus, the cross-sectional area of the metal being refined in the upper portion of the evaporator will be smaller than that in its lower portion, and in case the metal being refined is employed as a heater, its resistance in the upper portion of the evaporator will exceed that in the lower portion because of said difference in the cross-sectional areas. According to a well-known law, the amount of heat released varies in proportion to the resistance of a current lead. Hence, the amount of heat liberated in the upper portion of the evaporator will be larger than that obtained in its lower part. The law of energy redistribution along the evaporator height is determined by the conicity of the cylinder internal surface.

Owing to the redistribution of energy released in the evaporator the specific consumption of electric energy is decreased and a higher stability of the refining process is provided.

To extend the service life of the pipelines their material is protected by a thin crust of a solidified metal - wall accretions.

The latter are obtained by cooling the pipeline casing with water. To this end the casing is provided with a cooled jacket. The thickness of wall accretions is adjusted by using the combined effect of water-cooling and electric heating, with the heater being disposed between the pipeline casing and a refractory pipe, e.g., a graphite one.

The nature of the invention will be clear from the following detailed description of a particular embodiment of an apparatus for purifying tin from lead and bismuth by refining, according to the invention, to be had in conjunction with the accompanying drawings, in which.

Figure 1:
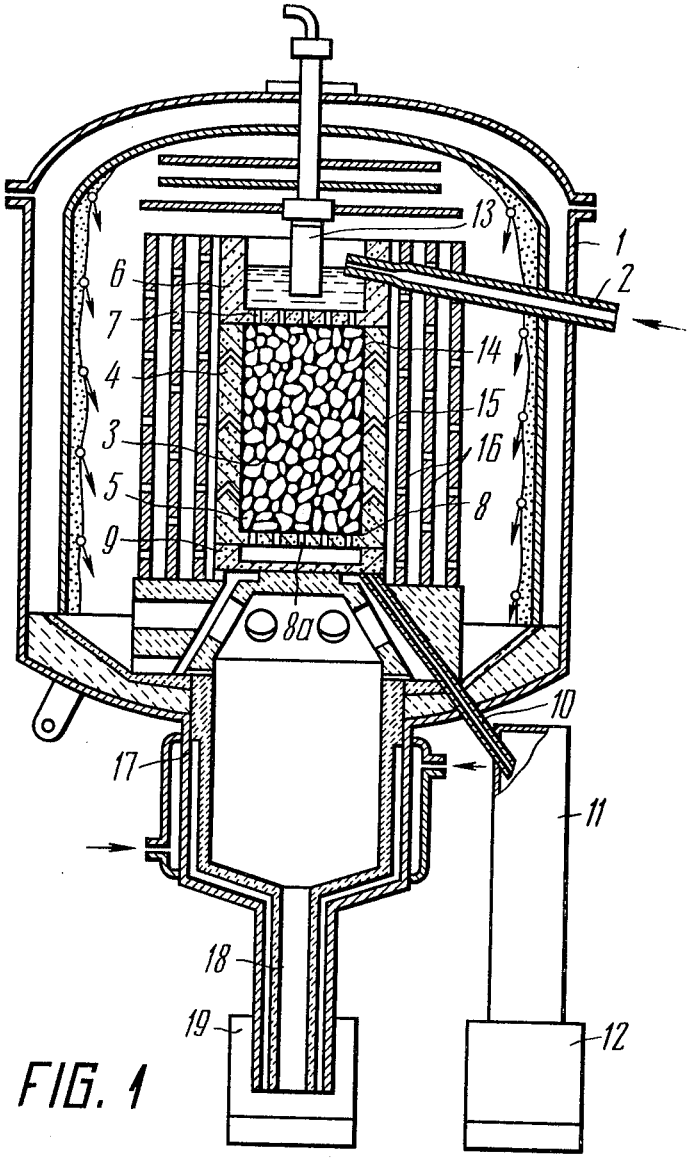
FIG. 1 is a longitudinal sectional view of an apparatus for continuous refining of tin, according to the invention, by using the tin to be refined as a heater.

An apparatus for continuous refining of tin under a vacuum comprises a cylindrical vacuum chamber 1 (FIG. 1) into which preliminary melted impure tin is fed via a pipeline 2.

The chamber 1 accommodated an evaporator — a vessel 3 formed by a graphite cylinder 4 filled to capacity with a granulated loose material 5, in this case, with graphite.

To provide a uniform distribution of tin being refined over the entire volume of the evaporator, mounted above the latter is an intake tray 6 with a plurality of outlets 7 in its bottom 8.

The bottom 8 of the graphite cylinder 4 is fitted with a number of drains 8*a* for discharging refined tin into a bottom plate 9 wherefrom it is delivered along a pipeline 10 into a cooler 11 and then into a tank 12.

When the tin being refined is employed as a heater, a rod 13 immersed into the molten tin in the intake tray 6 acts as a current lead for supplying electric energy to the metal. The bottom plate 9 associated electrically with the casing of the vacuum chamber 1 acts as another current lead. For changing the heater resistance along the evaporator heat an internal surface 14 of the graphite cylinder 4 is tapered, with its enlarged portion turned downwards.

To enable the effluence of volatilized impurities the cylinder 4 is fitted with outlets 15. The volatilized impurities get onto a system of perforated shields 16 whereon they are condensed and drain into a condensate header 17 from which they are discharged into a condensate tank 19 via a pipeline 18.

Figure 2:
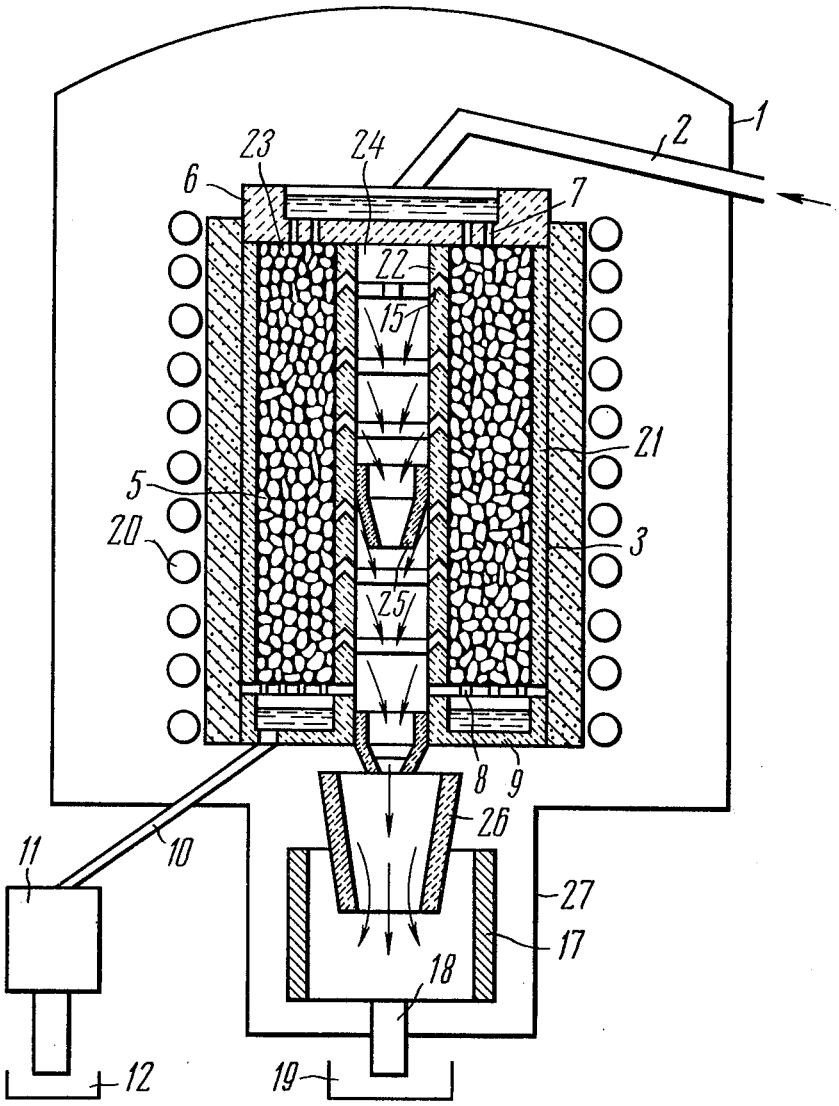
FIG. 2 is a longitudinal sectional view of an apparatus, according to the invention, wherein use is made of an induction heater.

FIG. 2 shows an apparatus for refining tin, according to the invention, equipped with an induction heater 20 encompassing the evaporator 3. In this case the evaporator is formed by two cylinders — an external cylinder 21 and an internal one 22 — disposed coaxially with respect to each other, aligned with the vacuum chamber 1 and separated by a clearance 23 filled with the granulated loosed material 5. With the above arrangement the outlets 15 for the effluence of volatilized impurities are located in the walls of the internal cylinder 22. The space 24 of the cylinder 22 accommodates tapered branch pipes 25 spaced at a distance, aligned axially therewith and forming in conjunction with the space 24 of the internal cyliner 22 a vapor pipe for the passage of impurities.

The vapor pipe communicates through an intermediate tapered branch pipe 26 with a condenser 27 wherefrom the liquefied impurities are discharged to the condensate tank 19 via a pipeline 18.

Figure 3:
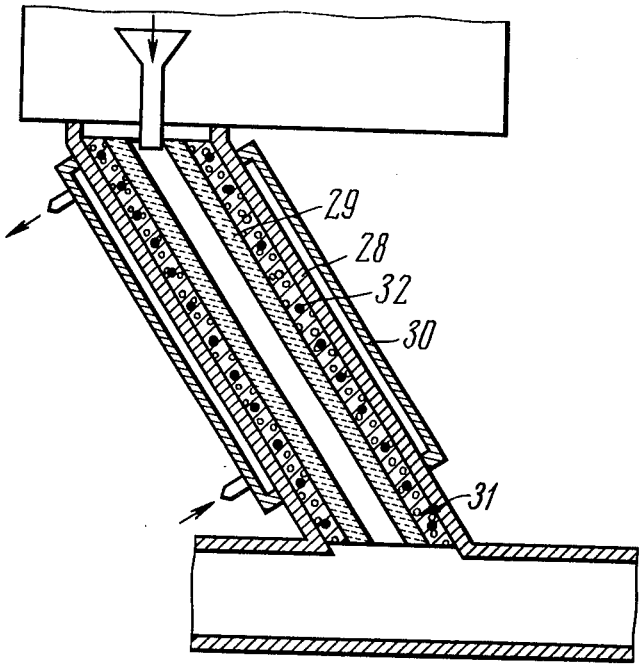
FIG. 3 is a longitudinal sectional view of a pipeline.

The pipelines 2, 10 and 18 comprise each a casing 28 (FIG. 3), a refractory pipe 29, a water-cooled jacket 30 and an electric heater 31. The heater 31 is embedded in a layer of concrete 32.

The herein-proposed apparatus operates in the following manner.

Preliminary melted impure tin is fed into the intake tray 6 of the vacuum chamber 1 along the pipeline 2. Passing through the outlets 7 the tin to be refined spreads over the entire volume of the granulated loose material 5 and is heated to an impurity boiling temperature owing to the energy supplied to the metal being refined via a current lead - rod 13. The volatilized impurities flow through the outlets 15 in the cylinder 4 to the system of perforated shields 16 whereon they are condensed and drained into the condensate head 17, from which the liquefied impurities are discharged to the condensate tank 19 via the pipeline 18.

The refined tin runs off through the drains 8*a* in the bottom 8 of the graphite cylinder 4 into the bottom plate 9 wherefrom it is delivered to the cooler 11 along the pipeline 10. Upon cooling to a temperature of 350°–450° C it flows off into the refined tin tank 12. The condensate and refined tin from the tanks 19 and 12 are cast into pigs.

In contrast to the outlined above, in the apparatus, illustrated in FIG. 2, the volatilized impurities flow through the outlets 15 in the internal graphite cylinder 22 into the space 24. Travelling along the vapor pipe, formed by the space 24 and tapered branch pipes 25, they (the volatilized impurities) get into the condenser 27 where they are condensed and cooled to a temperature of 350°–450° C. The liquefied impurities run off along the pipeline 18 to the condensate tank 19. As for the refined tin it follows the same path as in the above-described apparatus.

What is claimed is:

1. An apparatus for continuous vacuum-refining of metals, comprising: a cylindrical vacuum chamber; an evaporator for preliminary melted impure metal, said evaporator being accommodated in said vacuum chamber and constituting a vessel with a granulated loose material filling said vessel to capacity to provide a maximum evaporating surface washed by the molten metal being refined; a heater with a current lead to feed energy thereto for heating said vessel together with the metal to a volatilization temperature of low-boiling impurities; side walls of said vessel fitted with outlets for the effluence of the low-boiling impurities liberated during metal heating; a condensate header mounted under said vacuum chamber and adapted to collect the impurities; the bottom of said vessel with a drain for discharging the refined metal from said vacuum chamber; a tank adapted to receive the refined metal and disposed externally of said vacuum chamber.

2. An apparatus of claim 1, wherein said vessel-evaporator is formed by two cylinders — an internal one and an external cylinder — disposed coaxially with respect to each other, aligned with said vacuum chamber and separated by a clearance filled with a granulated loose material, and said outlets for the effluence of volatilized impurities are located in the walls of said internal cylinder; tapered branch pipes accommodated in said internal cylinder are spaced at a certain distance, aligned axially therewith and form in conjunction with the space of the internal cylinder a vapor pipe for discharging the impurities, communicating with said condensate header whose outlet is fitted with a pipeline enclosed in a water-cooled jacket and provided with an electric heater.

3. An apparatus of claim 1, wherein said vessel-evaporator for the granulated loose material is a cylinder with a bottom, whose interior is shaped as a truncated cone turned with its enlarged portion downwards to provide the redistribution of the energy, generated by the heater which is the metal being refined, along the cylinder height.

4. An apparatus of claim 1, wherein an electrically conductive material, such as, graphite, is employed as a loose granulated material.

* * * * *